United States Patent [19]

Graff

[11] 4,362,252

[45] Dec. 7, 1982

[54] SINGLE-USE SHEET PLASTIC CLOSURE FOR APPLICATION TO RIMMED CONTAINERS

[76] Inventor: Stewart M. Graff, c/o Douglas Stephens Plastics, Inc., 101 E. Main St., Little Falls, N.J. 07424

[21] Appl. No.: 354,141

[22] Filed: Mar. 5, 1982

Related U.S. Application Data

[63] Continuation-in-part of Ser. No. 281,477, Jul. 9, 1981, abandoned.

[51] Int. Cl.[3] ..... B65D 17/34

[52] U.S. Cl. ..... 220/270; 220/306

[58] Field of Search ..... 220/256, 270, 306; 215/256, 320; 206/605; 229/43; 150/5

[56] References Cited

U.S. PATENT DOCUMENTS 4,103,803 8/1978 Irvine ..... 220/270

4,298,133 11/1981 Davis ..... 220/306

*Primary Examiner*—George T. Hall

*Attorney, Agent, or Firm*—Kirschstein, Kirschstein, Ottinger & Cobrin

[57] ABSTRACT

A single-use sheet plastic closure is applied to a comestible-storing rimmed container of a similar shape. The closure has a crown and a continuous skirt downwardly dependent from the periphery of the crown. The skirt has at least one lug to mechanically lock the closure to the container. At the lower edge of the skirt is a pull tab operable for destroying the integrity of the locking lug when said tab is bent back and pulled. The pull tab extends angularly outwardly from the skirt to form a handle access portion an edge of which meets the skirt at a weak zone. When the pull tab is bent back and pulled, a tensile force is applied to the weak zone which will start a tear that progresses from the weak zone through the locking lug thus destroying the integrity of the mechanical lock and permitting the closure to be removed from the container and discarded.

14 Claims, 8 Drawing Figures

FIG. 1
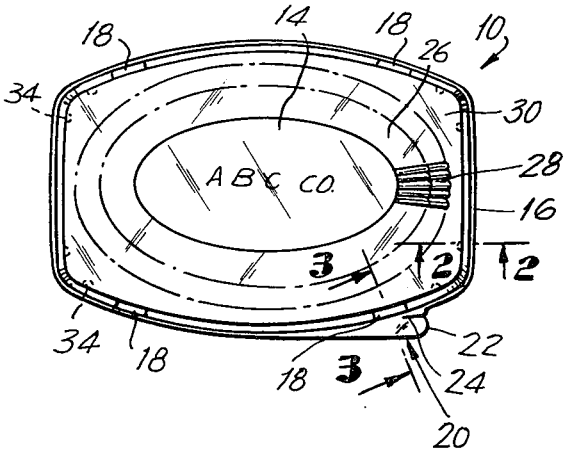
FIG. 2
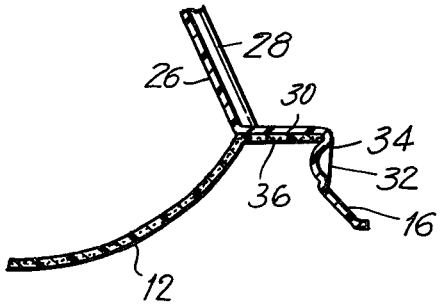
FIG. 3
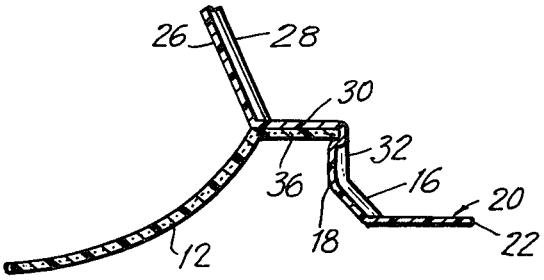
FIG. 4
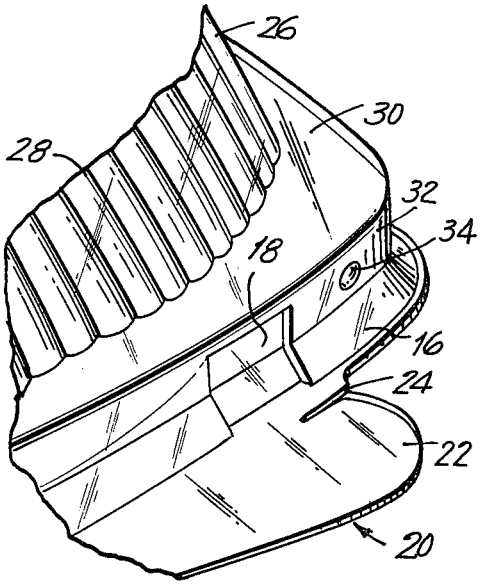
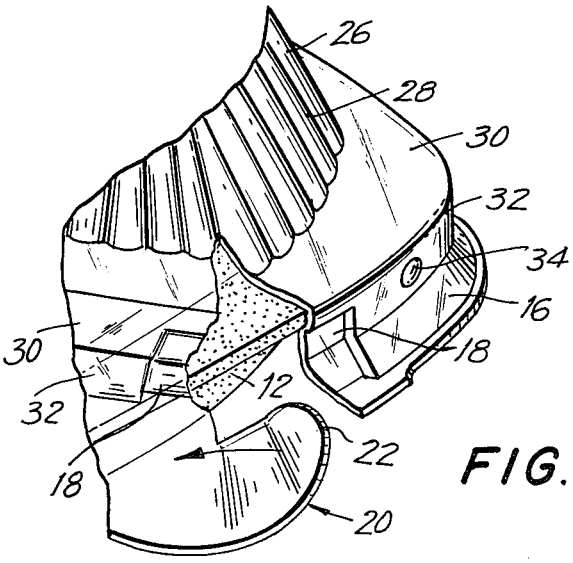
FIG. 5

FIG. 6
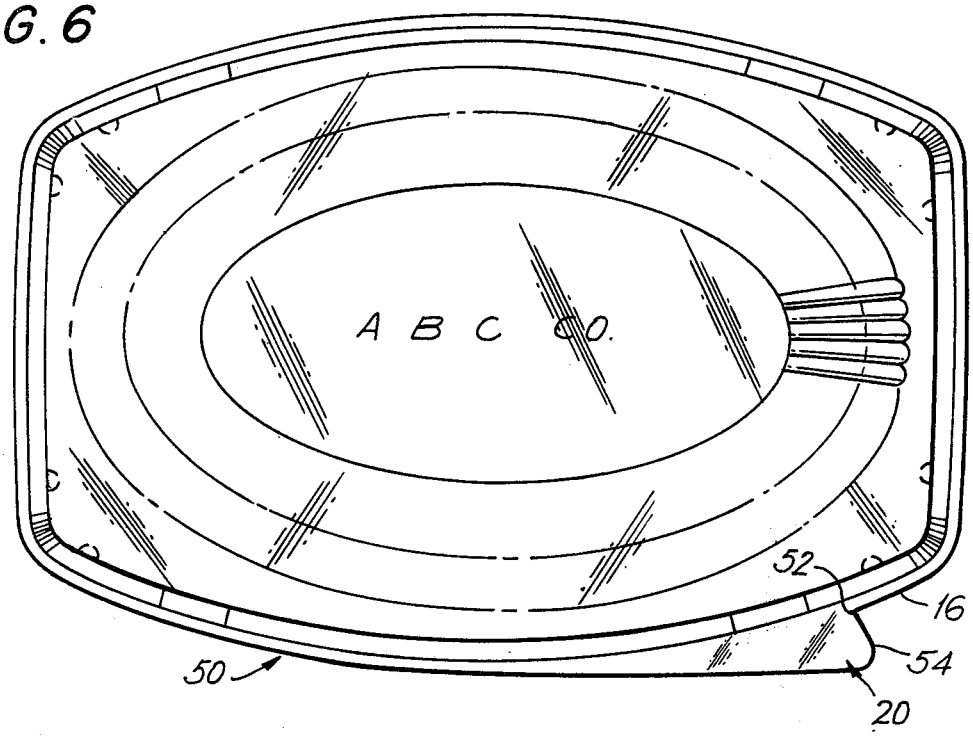
FIG. 7
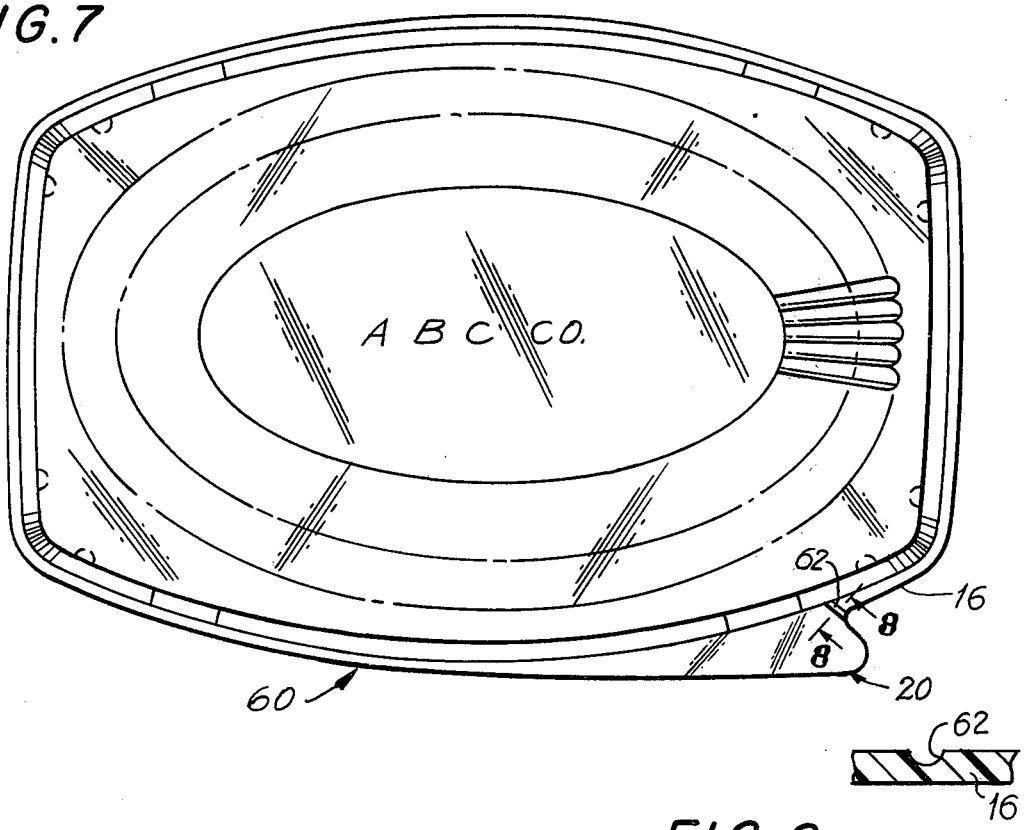
FIG. 8

SINGLE-USE SHEET PLASTIC CLOSURE FOR APPLICATION TO RIMMED CONTAINERS

CROSS-REFERENCE TO CO-PENDING APPLICATION

This application is a continuation-in-part of parent application Ser. No. 281,477 filed July 9, 1981 now abandoned for SINGLE-USE SHEET PLASTIC CLOSURE FOR APPLICATION TO RIMMED CONTAINERS.

BACKGROUND OF THE INVENTION

1. Field of the Invention

A single-use sheet plastic closure for application to rimmed containers of a similar shape and of the type in which edible goods are stored.

2. Description of the Prior Art

Edible goods are oftentimes stored in rimmed containers prior to their sale to consumers. It is desirable that said rimmed containers, when so filled with comestibles, be tightly closed so as to avoid accidental removal of the closure from the container with resultant accidental escape of the comestibles within the container.

Heretofore, when closures which provided a tight mechanical fit with the containers were used, difficulties arose when it was desired to remove said closures from said containers. If the closure on the container was difficult to remove therefrom, due to the tight mechanical fit of the closure on the container, oftentimes the contents of the container would be accidentally disgorged from same during the act of removing the closure from the container. Further, it was often necessary to use knives, scissors, etc. to open said tightly mechanically closed containers which was inconvenient and which also at times resulted in contamination of the comestibles within the container.

It is, of course, desirable to cover the comestible storing containers to thus protect the comestibles within said containers from contamination. Further, the covers and containers must both be relatively inexpensive to produce, apply and use so as not to unduly add to the selling price of the items contained therein.

U.S. Pat. No. 4,091,930 discloses a foil lid which is heat sealed to a container and which contains four tabs thereon for use in removing said lid from said container.

U.S. Pat. No. 3,572,500 discloses a plastic lid which is heat sealed to a plastic container and which contains thereon a radial tab to facilitate removal of the lid from the container.

Other relevant prior art patents are: U.S. Pat. Nos. 3,572,759; 3,830,396; 3,831,798; 4,190,175; 4,252,248; and 4,281,774.

SUMMARY OF THE INVENTION

1. Objects of the Invention

It is an object of the present invention to provide an improved closure for mechanical application to rimmed containers of the type usable to store edible goods.

It is another object to provide a closure of the type described which avoids the various disadvantages of prior art mechanical closures.

Still another object of the invention is to provide a tightly fitting mechanical closure of the type described which is not heat sealed to the container.

Yet a further object is the provision of a closure of the type described which tightly mechanically locks onto a container but which is easily removed therefrom.

Another object is the provision of an inexpensive closure of the type described which can be mechanically applied to a container without the use of specialized materials or machinery.

It is yet a further object of the invention to provide a mechanical closure of the type described which can be removed from a container using only a perons's hands.

An additional object is to provide a closure of the type described which can be removed from a container without distorting said container.

Other objects of the present invention in part will be obvious and in part will be pointed out hereinafter.

2. Brief Description of the Invention

In keeping with these objects and other which will become apparent hereinafter, one feature of the invention resides, briefly stated, in a one-piece sheet plastic single-use mechanical closure for application to rimmed containers of the type usable to hold edible goods.

The closure is peripherally rupturable at a weak zone and is characterized by the provision of: a crown; a skirt which is downwardly dependent from the periphery of said crown; means on said skirt for detachably and mechanically tightly locking the closure to the rim of a container; and a pull tab situated on the lower edge of the skirt and in proximity to said locking means, an edge of the tab being joined to the peripheral edge of the skirt at a weak zone.

The pull tab is operable for destroying the integrity of the locking means when said pull tab is bent back and pulled by a user. In a preferred form, said pull tab extends angularly outwardly from the skirt of the closure to form a handle access portion which is spaced away from the skirt to define a notch with a narrow apex at the lower edge of said skirt which constitutes a weak zone.

Alternately, the weak zone can constitute a sharp corner joining the lower edge of the skirt to an edge of the pull tab, or can constitute a thinned portion of the lower edge of the skirt situated where an edge of the pull tab joins the lower edge of the skirt.

When a user desires to remove the closure from the container, the user bends back and pulls the pull tab, thus applying a tensile force to same. Said tensile force starts a tear in the closure which progresses from the weakened zone through the locking means. The tear destroys the integrity of the locking means and permits the closure to be removed from the container and then discarded by the user.

Another feature of the present invention resides in a method for non-permanently storing edible goods in rimmed containers using the above-described peripherally rupturable closure. After edible goods are placed in an appropriate container, the latter is tightly and mechanically lockingly covered with the closure. When a consumer desires to use the comestible stored in said container, he bends back and pulls on the pull tab of the closure to thus tear said closure along a line of action which extends from the weakened zone through the locking means. In this manner, the integrity of the locking means is destroyed, thus permitting the closure to be removed from the container and thereby permitting access to the edible goods stored therein.

The novel features which are considered as characteristic of the invention are set forth in particular in the appended claims. The invention itself, however, both as to its construction and its method of operation, together with additional objects and advantages thereof, will best be understood from the following description of specific embodiments when read in connection with the accompanying drawings.

BRIEF DESCRIPTION OF THE DRAWINGS

FIG. 1 is a top plan view of a one-piece sheet plastic single-use closure of the invention wherein the weakened zone is of the notch type;

FIG. 2 is an enlarged sectional view taken substantially along line 2—2 of FIG. 1;

FIG. 3 is an enlarged sectional view taken substantially along line 3—3 of FIG. 1;

FIG. 4 is a partially broken away enlarged perspective view of the lower right-hand corner of the closure of FIG. 1;

FIG. 5 is a view substantially analogous to FIG. 4 after the pull tab has been pulled and the integrity of the locking means destroyed;

FIG. 6 is a view similar to FIG. 1 wherein the weakened zone is of the sharp corner type;

FIG. 7 is a view similar to FIG. 1 wherein the weakened zone is of the thinned type; and FIG. 8 is an enlarged sectional view taken substantially along the line 8—8 of FIG. 7.

DETAILED DESCRIPTION OF THE PREFERRED EMBODIMENTS

Referring now to the drawings, and more particularly to FIG. 1, the reference numeral 10 denotes a one-piece sheet plastic closure of the present invention shown mechanically locked in place on a rimmed container 12. When used herein locked to, or locked on the container, denotes that the closure is securely mechanically attached to said container such that it cannot be removed therefrom without partially destroying the integrity of the closure.

Container 12 is usable to hold comestibles and is of substantially the same size and shape as closure 10. Closure 10 and container 12 may be of any appropriate size and shape, the only requirement being that the size and shape of the closure be substantially similar to the size and shape of the container so that the closure may be mechanically applied to and tightly mechanically locked on the container. In one preferred embodiment, both said closure and said container are circularly shaped in plan. In another embodiment, both said closure and said container are ovoid shaped in plan.

The closure 10 may be formed of any appropriate sheet plastic material, and in a preferred embodiment said closure is formed of a transparent sheet plastic so that the comestibles held within the container are viewable to consumers. Preferably, said sheet plastic material is slightly flexible to permit the closure to be locked onto the container. Indicia means 15 may be included on the closure and, by way of example, said indicia means 15 may constitute printing on said closure indicating the store in which the comestibles in the container were purchased.

Closure 10 is formed to be peripherally rupturable and it is intended that said closure, in its unimpaired state, be usable only a single time. As aforementioned, said closure is only slightly flexible so that said flexibility will not interfere with the rupturability of said closure.

Closure 10 is provided with a crown 14 having a vertical plane of symmetry and a skirt 16 which is operatively attached to and downwardly dependent from crown 14. Skirt 16 may be attached directly to crown 14, or, as in the preferred embodiment shown in the drawing, there may be other elements of closure 10 located intermediate crown 14 and skirt 16 as detailed hereinafter.

Positioned on and spaced about skirt 16 are a plurality of main mechanical locking means 18 for detachably and mechanically tightly locking closure 10 to the rim of container 12. Main locking means 18, in a preferred embodiment, are a series of inwardly and downwardly directed lugs which are shaped and dimensioned to lockingly mechanically fit under the rim of container 12.

A pull tab 20 is positioned on the closure 10 at the lower edge of the skirt 16. Said pull tab 20 in a preferred embodiment is in proximity to one of the main locking means 18. Pull tab 20 extends angularly outwardly from said skirt 16 to form a handle access portion 22. As shown, the pull tab is tangential to the periphery of the skirt. Handle access portion 22 is spaced away from the skirt 16 and defines a notch 24 with a narrow apex at the lower edge of the skirt 16. Said notch constitutes a weakened zone. Pull tab 20 is operable for destroying a portion of the periphery of closure 10. In a preferred embodiment, pull tab 20 is operable for destroying the main locking means 18 situated closest to it when said pull tab is bent back and pulled by a user. When so bent back and pulled, pull tab 20 has a tensile force applied thereto which starts a tear at the weakened zone, best shown in FIG. 5, which progresses from the apex of notch 24 through a portion of the periphery of closure 10 and/or through locking means 18. Said tear destroys the integrity of a portion of the periphery of closure 10 and/or the main locking means 18 and thereby permits closure 10 to be removed from container 12.

In a preferred embodiment, closure 10 contains a side wall 26 which is immediately adjacent to and downwardly dependent from crown 14. Preferably, side wall 26 contains a series of flutes 28 thereon. The fluting on said side wall provides the closure 10 with additional flexibility. Additionally, in a preferred embodiment, closure 10 contains a peripheral flange 30 positioned adjacent to side wall 26 and intermediate side wall 26 and skirt 16. Flange 30 is shaped and dimensioned to rest on a peripheral flange 36 of container 12. The closure may additionally contain a second auxiliary skirt 32. Situated on auxiliary skirt 32 are a plurality of auxiliary mechanical locking means 34. Each auxiliary mechanical locking means 34 is positioned proximate to one of said plurality of main mechanical locking means 18 and comprises inwardly extending generally semicircular detent knobs which snappingly fit under and thereby engage the rim of container 12.

Main mechanical locking means 18 and auxiliary mechanical locking means 34 cooperate to detachably mechanically connect closure 10 to container 12. Said detachable mechanical connection is a reasonably firm one which eliminates the possibility of closure 10 accidentally falling off of container 12 and thereby said connection prevents the accidental spillage of the comestibles held within the container 12. As heretofore mentioned, closure 10 mechanically locks onto container 12 such that the former cannot be removed from the latter without destroying the integrity of at least part of the closure.

The provision of a narrow apex in notch 24 facilitates the tearing or cracking of the main locking means. Said narrow apex concentrates the tensile force applied to pull tab 20 when said pull tab is bent back and pulled by a user. The aforementioned tear, which progresses from the apex of notch 24 through the main locking means and/or a portion of the periphery of closure 10, does not completely destroy the structure of the side wall 26 and crown 16 of the closure 10 and, hence, closure 10, though partially ripped, can be replaced upon container 12 to thereby afford some protection to comestibles not taken out of container 12 after the closure is first removed from same. Although this recovering of the container with the partially ripped closure is possible, it is, as aforementioned, intended that the partially ripped container will be discarded subsequent to its removal from the container.

Closure 10 and its associated container 12 together provide a method for non-permanently storing comestibles. A person places comestibles in container 12 and then tightly mechanically locks closure 12 on said filled container by snappingly fitting both main mechanical locking means 18 and auxiliary mechanical locking means 34 under the rim of the container. In this way, the comestibles within container 12 are protected from dirt and dust by said container and closure and said comestibles are securely held within said closed container. When a user wishes to remove closure 10 and thereby gain access to the comestibles in the container, he grasps pull tab 20 by its handle access portion 22 and bends back and pulls said pull tab. This bending and pulling action by a user creates a tensil force that starts a tear which progresses from the apex of notch 24 through a portion of the periphery of closure 10 and/or the main mechanical locking means 18 adjacent same to thus destroy the integrity of either a portion of the periphery of the closure 10 or the locking means. This destruction of the integrity of either the locking means and/or a portion of the periphery of closure 10 permits closure 10 to be easily removed from the container 12 and hence gives the user access to the comestibles held within said container. In this manner, the comestibles are non-permanently securely stored in the container until such time as a user desires to gain access to said comestibles, said access being easily gained by a user without the need of any extraneous instruments. To gain access to the comestibles within the container, a user needs only his own hands and body strength.

In FIG. 6, a closure 50 is illustrated which is similar to the closure 10 but differs therefrom in the construction of the weakened zone. It will be recalled that the weakened zone of the closure 10 constituted a notch with a narrow apex between an edge of the pull tab and the peripheral edge of the skirt. The weakened zone of the closure of FIG. 6, instead of the notch, utilizes a sharp corner 52 between an edge 54 of the pull tab 20 and the peripheral edge of the skirt 16. This sharp corner concentrates the tensile force applied to the pull tab 20 when said pull tab is bent back and pulled by a user whereby to start a tear that progresses from the corner 52 through the locking means and/or a portion of the periphery of the closure 50, thus destroying the integrity of the locking means and/or periphery of the closure which thereupon can be readily removed from the container.

In FIG. 7, a closure 60 is illustrated which is similar to the closure 10 but differs therefrom in the construction of the weakened zone. The weakened zone of the closure of FIG. 7, instead of the notch 24, utilizes a linear thinned zone 62 having one end at the corner between an edge of the pull tab 20 and the peripheral edge of the skirt 16. This corner, in the form of the invention shown in FIG. 7, need not be a sharp corner and, indeed, is not shown as one.

It will be seen from inspection of FIG. 8 that the thinned zone has a thickness less than the thickness of the skirt, for example, about half the thickness, so that the tensile force created upon bending back and pulling the tab 20 is sufficient to rip the skirt at the weakened zone, thus starting a tear which progresses from the weakened zone through the main locking means and/or or portion of the periphery of the skirt to destroy the integrity of the main locking means and/or a portion of the periphery of the skirt, whereupon the closure 62 can readily be removed from the container.

It will be understood that each of the elements described above, or two or more together, may also find a useful application in other types of constructions differing from the types described above.

While the invention has been illustrated and described as embodied in a single-use sheet plastic closure for application to rimmed containers of a similar shape and of the type in which edible goods are stored, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspect of this invention and, therefore, such adaptations should and are intended to be comprehended within the meaning and range of equivalence of the following claims.

Having thus described the invention, there is claimed as new and desired to be secured by Letters Patent:

1. A one-piece sheet plastic peripherally rupturable single-use closure for application to rimmed containers of the same shape and of the type usable to hold edible goods comprising:

(A) a crown having a vertical plane of symmetry;

(b) a skirt downwardly dependent from the periphery of the crown;

(c) means in one piece with the skirt for detachably and mechanically tightly locking said closure to the rim of the container; and (D) a pull tab in one piece with the closure at the lower edge of the skirt for destroying the integrity of the periphery of the closure when bent back and pulled, said pull tab extending angularly outwardly to form a handle access portion and having an edge spaced away from the skirt to define a notch with a narrow apex at the outer edge of the skirt, whereby when the pull tab is bent and has a tensile force applied thereto it will start a tear which will progress from the apex of the notch through a portion of the periphery of the closure to destroy the integrity of said periphery and permit the closure to be removed from the container and discarded.

2. The plastic closure of claim 1, wherein the pull tab is in proximity to the locking means.

3. The plastic closure of claim 1, wherein the portion of the periphery of the closure is destroyed when the pull tab is pulled by a user is the locking means.

4. The plastic closure of claim 1, and additionally comprising a side wall being immediately adjacent and downwardly dependent from the crown and a peripheral flange positioned adjacent to and intermediate said side wall and said skirt.

5. The plastic closure of claim 4, wherein said side wall is fluted.

6. The plastic closure of claim 1, wherein said closure is transparent.

7. The plastic closure of claim 1, wherein said closure is circularly shaped in plan.

8. The plastic closure of claim 1, wherein said closure is ovoid shaped in plan.

9. The plastic closure of claim 1, wherein said pull tab is tangential to the periphery of the skirt.

10. The plastic closure of claim 1, and additionally comprising indicia means positioned on said crown.

11. A method for non-permanently storing comestibles using the plastic closure of claim 1, comprising the steps of:

(A) providing a rimmed container of a size and shape compatible with the closure;

(B) placing comestibles in the container;

(C) tightly locking the closure on the container filled with comestibles such that said comestibles are not directly exposed to the environment and such that said comestibles are securely held in said closed container; and (D) opening said container when it is desired to use the comestibles contained therein by bending back and pulling on the tab to thereby start a tear which progresses from the apex of the notch through a portion of the periphery of the closure thus destroying the integrity of said periphery and permitting removal of said closure from said container.

12. A one-piece sheet plastic peripherally rupturable single-use closure for application to rimmed containers of the same shape and of the type usable to hold edible goods comprising:

(A) a crown having a vertical plane of symmetry;

(B) a skirt downwardly dependent from the periphery of the crown;

(C) means in one piece with the skirt for detachably and mechanically tightly locking said closure to the rim of the container; and (D) a pull tab in one piece with the closure at the lower edge of the skirt for destroying the integrity of the periphery of the closure when bent back and pulled, said pull tab extending angularly outwardly to form a handle access portion and having an edge joined to the outer edge of the skirt at a weakened zone, whereby when the pull tab is bent and has a tensile force applied thereto it will start a tear which will progress from the weakened zone through a portion of tfhe periphery of the closure to destroy the integrity of said periphery and permit the closure to be removed from the container and discarded.

13. The plastic closure of claim 12, wherein the weakened zone constitutes a sharp corner where an edge of the pull tab meets the peripheral edge of the skirt.

14. The plastic closure of claim 12, wherein the weakened zone constitutes a linear area in the outer edge of the skirt which is thinner than the remainder of the skirt and which has one end at a corner joining an edge of the pull tab to the outer edge of the skirt.

* * * * *